US006974312B2

(12) United States Patent
Abdelrahman et al.

(10) Patent No.: US 6,974,312 B2
(45) Date of Patent: Dec. 13, 2005

(54) PUMPING ELEMENT FOR HYDRAULIC PUMP

(75) Inventors: Ibrahim A. Abdelrahman, Peoria, IL (US); Dennis H. Gibson, Chillcothe, IL (US)

(73) Assignee: Caterpillar Inc., Peoria, IL (US)

( * ) Notice: Subject to any disclaimer, the term of this patent is extended or adjusted under 35 U.S.C. 154(b) by 323 days.

(21) Appl. No.: 10/318,404

(22) Filed: Dec. 13, 2002

(65) Prior Publication Data

US 2004/0115066 A1 Jun. 17, 2004

(51) Int. Cl.[7] ..... F04B 1/28; F04B 49/24
(52) U.S. Cl. ..... 417/289; 123/449
(58) Field of Search ..... 123/449, 500, 123/501; 417/289, 270, 440

(56) References Cited

U.S. PATENT DOCUMENTS

| | | | | |
|---|---|---|---|---|
| 3,615,043 A | | 10/1971 | Hussey et al. | |
| 3,752,138 A | | 8/1973 | Gaines | |
| 4,023,539 A | | 5/1977 | Noguchi et al. | |
| 4,273,091 A | | 6/1981 | Stump et al. | |
| 4,499,883 A | | 2/1985 | Miyaki et al. | |
| 4,649,883 A | * | 3/1987 | Bohringer et al. | 123/449 |
| 4,897,024 A | | 1/1990 | Hatz et al. | |
| 5,364,243 A | | 11/1994 | Ishimoto | |
| 5,873,346 A | * | 2/1999 | Haberland | 123/449 |
| 5,957,674 A | | 9/1999 | Zenmei et al. | |
| 6,035,828 A | | 3/2000 | Anderson et al. | |
| 6,427,663 B1 | | 8/2002 | Breeden | |

FOREIGN PATENT DOCUMENTS

| | | | |
|---|---|---|---|
| FR | 2568944 | * | 2/1986 |
| JP | 54-102423 | * | 8/1979 |
| WO | WO 0161193 | | 8/2001 |

* cited by examiner

*Primary Examiner*—Michael Koczo, Jr.
(74) *Attorney, Agent, or Firm*—Finnegan, Henderson, Farabow, Garrett & Dunner LLP

(57) ABSTRACT

A pumping element for a hydraulic pump is provided. The pumping element includes a cylinder forming a compression chamber and having a discharge port. A piston having a pressure surface, a spill port, and a passageway connecting the pressure surface with the spill port is disposed in the cylinder for reciprocal movement between a first position and a second position. The pressure surface of the piston is adapted to increase the pressure of a fluid disposed in the compression chamber as the piston moves between the first position and the second position. The pressurized fluid flows through the discharge port of the cylinder. A metering sleeve is disposed around the piston and is configured to selectively cover the spill port as the piston reciprocates between the first and second positions. The metering sleeve has a groove that is adapted for fluid communication with the spill port as the piston reciprocates between the first and second positions.

20 Claims, 3 Drawing Sheets

PUMPING ELEMENT FOR HYDRAULIC PUMP

TECHNICAL FIELD

The present disclosure is directed towards hydraulic pumps and, more particularly, to a pumping element for a hydraulic pump.

BACKGROUND

Hydraulic pumps are commonly used for many purposes and in many different applications. Vehicles, such as, for example, highway trucks and off-highway work machines, commonly include hydraulic pumps that are driven by an engine in the vehicle to generate a flow of pressurized fluid. The pressurized fluid may be used for any of a number of purposes during the operation of the vehicle. A highway truck, for example, may use pressurized fluid to operate a fuel injection system or a braking system. A work machine, for example, may use pressurized fluid to propel the machine around a work site or to move a work implement.

A hydraulic pump typically includes a pumping element that applies work to an operating fluid to increase the pressure of the fluid. In one type of hydraulic pump, the pumping element includes a series of piston that are disposed in cylinders. The pistons are driven through a reciprocal movement within the cylinders to compress the operating fluid. The pumping element may be fixed displacement, where the stroke length of the pistons is constant. Alternatively, the pumping element may be variable displacement, where the stroke length of the pistons may be varied.

As shown in U.S. Pat. No. 6,035,828 to Anderson et al., a fixed displacement pump may include a metering device that allows the output flow rate of the pump to be varied. In the described system, the metering device includes a series of metering sleeves that are disposed around a series of pistons. The metering sleeves are configured to selectively block a passageway that provides a fluid connection with a compression chamber in the cylinder. When the passageway is open, operating fluid may flow from the compression chamber through the passageway to thereby prevent pressurization of the operating fluid during the compression stroke of the piston. The rate at which the pump generates pressurized fluid may be controlled by varying the position of the metering sleeves. The rate of pressurized fluid generation may be increased by covering the passageway for a greater portion of the compression stroke. The rate of pressurized fluid generation may be decreased by leaving the passageway open for a greater portion of the compression stroke.

The metering sleeves have a close tolerance relative to the outer surface of the pistons to minimize the amount of fluid that leaks from the passageway. It is expected that some operating fluid will leak from the passageway through the clearance between the metering sleeve and the piston surface. This fluid may be used to lubricate the surfaces of the metering sleeve and piston, which may facilitate movement between the metering sleeve and piston. Under some operating conditions, such as when the engine is cold, the viscosity of the operating fluid may be relatively high. The high viscosity of the fluid results in a greater drag between the metering sleeve and the piston. This increases the force required to move the metering sleeve relative to the piston.

Accordingly, accurately controlling the position of the metering sleeve relative to the piston may be more difficult when the engine is cold.

In addition, when the metering sleeves are covering the spill ports, an inner surface of the metering sleeves will be exposed to the pressurized fluid within the compression chamber. Particularly in high pressure systems, the pressurized fluid exerts a significant force on the inner surface of the metering sleeve. Over time, this force may cause the metering sleeve to swell or deform. The swelling or deformation of the metering sleeve may increase the clearance between the metering sleeve and the piston. The increased clearance may lead to an increase in the amount of fluid that leaks from the passageway, which may decrease the volumetric efficiency of the pump.

The pumping element of the present disclosure solves one or more of the problems set forth above.

SUMMARY OF THE INVENTION

According to one aspect, the present disclosure is directed to a pumping element for a hydraulic pump. The pumping element includes a cylinder that forms a compression chamber and has a discharge port. A piston having a pressure surface, a spill port, and a passageway connecting the pressure surface with the spill port is disposed in the cylinder for reciprocal movement between a first position and a second position. The pressure surface of the piston is adapted to increase the pressure of a fluid disposed in the compression chamber as the piston moves between the first position and the second position. The pressurized fluid flows through the discharge port of the cylinder. A metering sleeve is disposed around the piston and is configured to selectively cover the spill port as the piston reciprocates between the first and second positions. The metering sleeve has a groove that is adapted for fluid communication with the spill port as the piston reciprocates between the first and second positions.

In another aspect, the present disclosure is directed to a method of operating a metering sleeve in a hydraulic pump. A piston is driven through a reciprocal movement in a cylinder to pressurize an operating fluid. The operating fluid is released from the cylinder through a discharge port when the pressure of the operating fluid reaches a predetermined limit. The position of a metering sleeve is adjusted to selectively cover a spill port to vary the amount of operating fluid pressurized by the piston. Pressurized operating fluid is allowed to flow from the spill port to a groove in the metering sleeve as the piston reciprocates within the cylinder.

DETAILED DESCRIPTION

Figure 1:
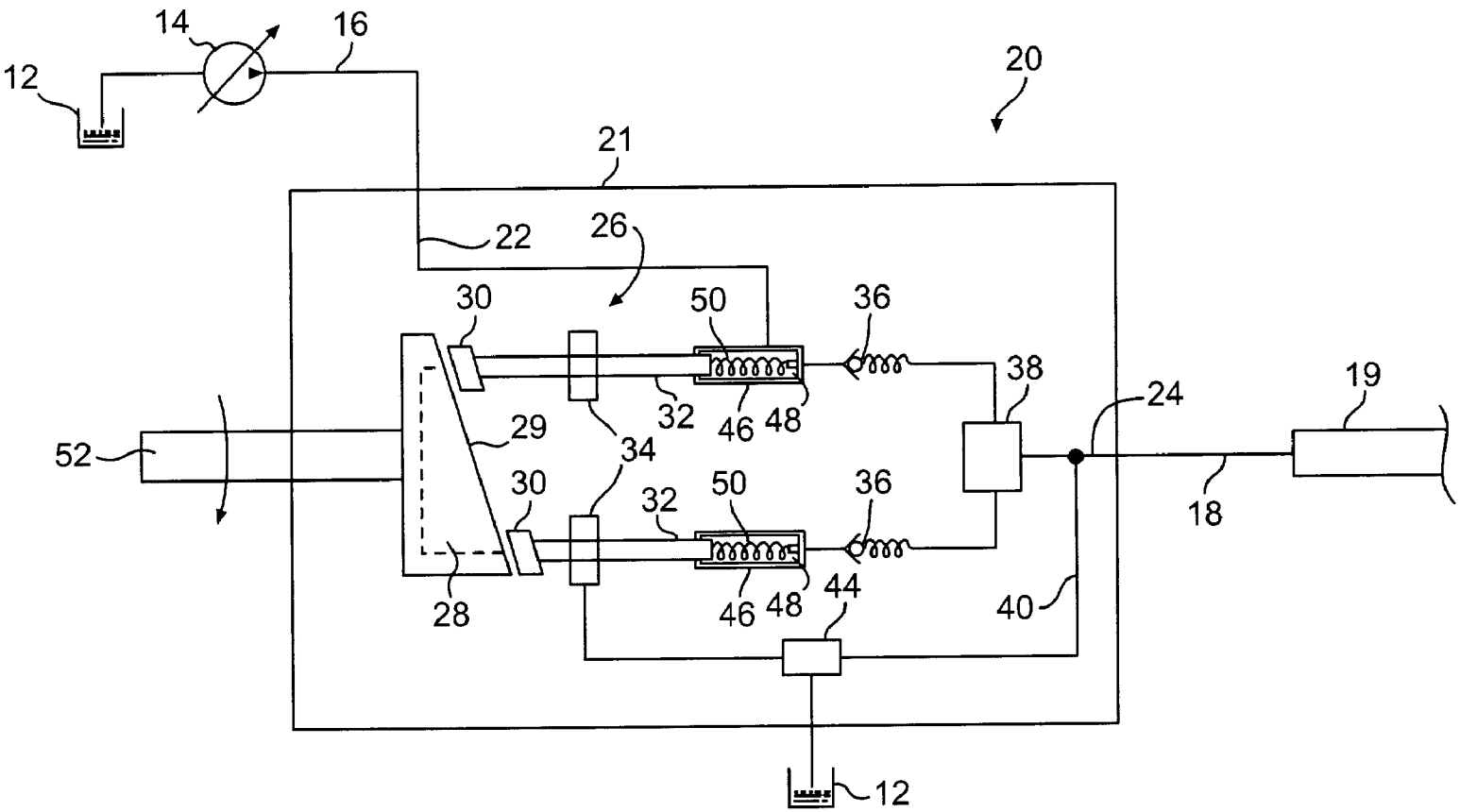
FIG. 1 is a schematic and diagrammatic representation of a hydraulic pump in accordance with an exemplary embodiment of the present invention.

An exemplary embodiment of a pump 20 is diagrammatically and schematically illustrated in FIG. 1. Pump 20 includes a housing 21 and an inlet 22. Inlet 22 may be connected to a tank 12 that stores a supply of operating fluid. The operating fluid may be any hydraulic fluid, such as, for example, any lubricating oil commonly used to lubricate moving engine parts. In addition, tank 12 may be part of a vehicle lubrication system, such as, for example, an oil sump.

A supply pump 14 may draw operating fluid from tank 12 and direct the operating fluid through an inlet line 16 to inlet 22 of pump 20. Supply pump 14 may be a relatively low pressure pump, such as, for example, a sump pump as is commonly used in a vehicle lubrication system to distribute lubricating oil within an engine and/or vehicle. Supply pump 14 may increase the pressure of the fluid to a relatively low pressure, such as, for example, about 70 kPa (10.2 psi).

As also illustrated in FIG. 1, pump 20 includes a pumping element 26. Pumping element 26 is operable to increase the pressure of the operating fluid received through inlet 22. Pumping element 26 includes a series of cylinders 46, each of which has a compression chamber 48 and a discharge port 49. Low pressure operating fluid may be directed from inlet 22 into each compression chamber 48.

Figure 2A:
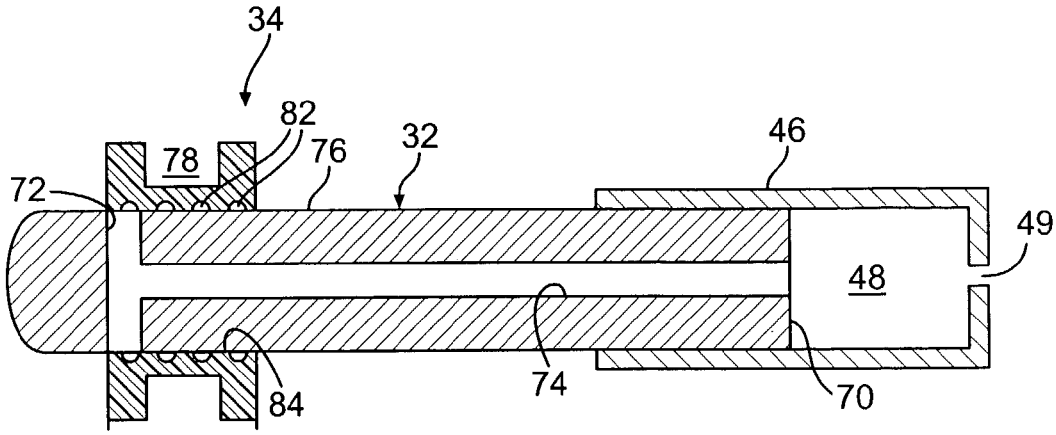
FIGS. 2*a* and 2*b* are schematic and diagrammatic representations of a metering sleeve and piston in accordance with an exemplary embodiment of the present invention.
Figure 2B:
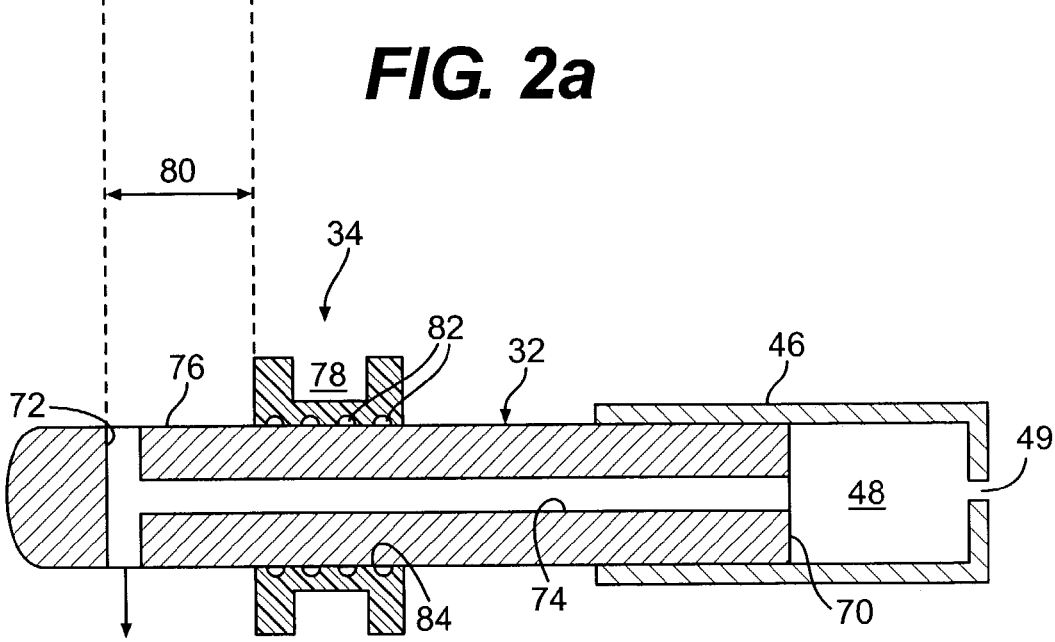

Pumping element 26 also includes a series of pistons 32. One piston 32 is slidably disposed within each cylinder 46. As shown in FIGS. 2*a* and 2*b*, each piston 32 includes an outer surface 76 and a pressure surface 70. Pressure surface 70 is disposed adjacent compression chamber 48. Each piston 32 is reciprocally moveable through a compression stroke, where each piston 32 is moved from a first position to a second position to increase the pressure of operating fluid contained in compression chamber 48. The length of the compression stroke is indicated by distance 80. The pressurized operating fluid may exit compression chamber 48 through discharge port 49.

As also shown in FIGS. 2*a* and 2*b*, piston 32 includes a passageway 74 and a spill port 72. Passageway 74 provides a fluid conduit between pressure surface 70 and spill port 72. In the illustrated embodiment, spill port 72 provides two openings on either side of piston 32. It should be understood that spill port 72 may provide a greater, or lesser, number of openings from passageway 74.

Referring to FIG. 1, a resilient member, such as, for example, spring 50, may be operatively engaged with each piston 32. Spring 50 may act on piston 32 to move piston 32 towards the first position. As shown, spring 50 may be disposed within cylinder 48. Alternatively, spring 50 may be positioned in any other location readily apparent to one skilled in the art where spring 50 may act to move piston 32 towards the first position.

As further shown in FIG. 1, pump 20 may also include an input shaft 52 that is operable to drive pumping element 26. Input shaft 52 may include a spline or keyed end that is operatively engaged with the crankshaft or gear train of the engine. Input shaft 52 may be connected to the engine in any manner readily apparent to one skilled in the art that will result in a rotation of input shaft 52.

Pump 20 may further include a swashplate 28 that is rotatably disposed in housing 21. Swashplate 28 may include an angled driving surface 29. Input shaft 52 may be connected to swashplate 28 so that a rotation of input shaft 52 causes a corresponding rotation of swashplate 28 and driving surface 29.

Driving surface 29 of swashplate 28 is operatively engaged with each piston 32. Driving surface 29 is angled so that rotation of swashplate 28 sequentially moves each piston 32 from the first position to the second position. After each piston 32 has reached the second position and as swashplate 28 continues to rotate, springs 50 will move each piston 32 from the second position towards the first position.

A device, such as, for example, a pivoting shoe 30, may be disposed between each piston 32 and driving surface 29. Pivoting shoe 30 is configured to pivot relative to piston 32. The pivoting motion ensures that the respective piston 32 will remain operatively engaged with driving surface 29 as swashplate 28 rotates.

In the illustrated embodiment, driving surface 29 of swashplate 28 has a fixed angle. It should be noted, however, that pump 20 may include a mechanism configured to vary the angle of driving surface 29. By varying the angle of driving surface 29, the amount of motion, or the length of the compression stroke, of each piston 32 may be changed.

As further illustrated in FIG. 1, a check valve 36 may be disposed proximate discharge port 49 of each cylinder 46. Each check valve 36 may be configured to open when the fluid within compression chamber 48 bore reaches a predetermined level. When the operating fluid reaches the predetermined pressure, check valve 36 will open to allow the pressurized fluid to flow from compression chamber 48.

Hydraulic pump 20 may include a collector 38. Pressurized operating fluid that is released from each compression chamber 48 through check valve 36 may be directed to collector 38. Collector 38 may be configured to store a desired quantity of pressurized operating fluid.

Collector 38 is connected to an outlet 24, which may be further connected to an outlet line 18. Outlet line 18 may be connected to a fluid rail 19. Fluid rail 19 may be configured to distribute pressurized operating fluid to a system, such as, for example, a fuel injection system, associated with a vehicle and/or engine.

As also schematically shown in FIG. 1, hydraulic pump 20 includes a series of metering sleeves 34. One metering sleeve 34 is associated with each piston 32 and cylinder 46 combination. As described in greater detail below, each metering sleeve 34 is configured to control the rate at which pressurized fluid is generated by the respective piston 32.

Figure 3:
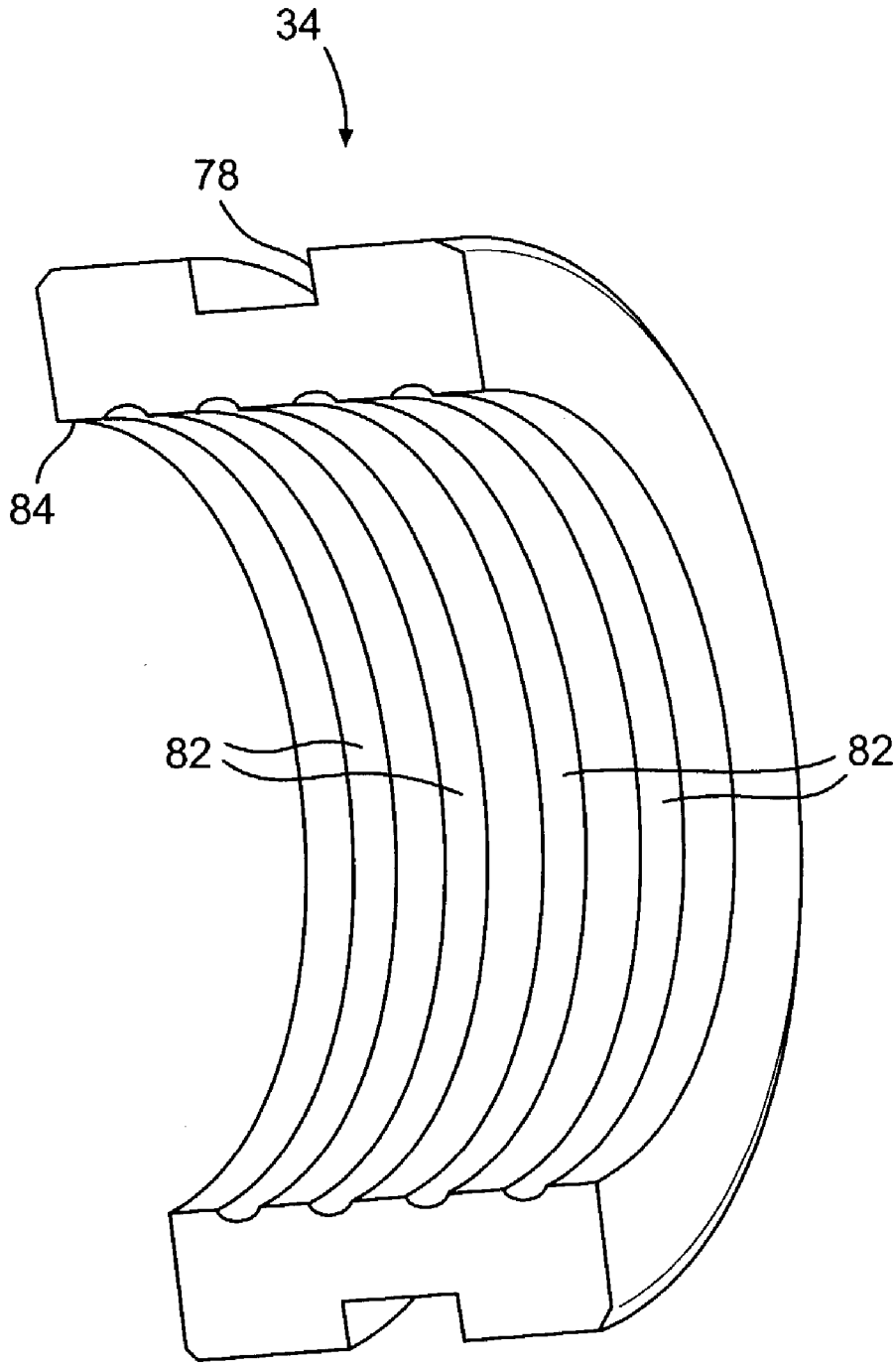
FIG. 3 is a partial pictorial representation of a metering sleeve in accordance with an exemplary embodiment of the present invention.

As illustrated in FIGS. 2*a*, 2*b*, and 3, metering sleeve 34 includes a position notch 78 and an inner surface 84. Inner surface 84 of metering sleeve 34 is configured to receive piston 32 and to cover spill port 72 to block passageway 74. The width of metering sleeve 34 may be approximately equal to distance 80 of compression stroke 80 so that metering sleeve 34 may cover spill port 72 for the entire compression stroke 80.

As also shown in FIG. 3, inner surface 84 includes a series of grooves 82. Grooves 82 enter into fluid communication with spill port 72 as piston 32 reciprocates between the first and second positions. In the illustrated embodiment, inner surface 84 includes a series of four grooves 82. It should be understood, however, that inner surface 84 may include a greater, or lesser, number of grooves 82.

As shown in FIGS. 2*a* and 2*b*, metering sleeve is disposed for sliding movement along outer surface 76 of piston 32. Metering sleeve 34 may be moved between a first position, as illustrated in FIG. 2*a*, and a second position, as illustrated in FIG. 2*b*.

The position of metering sleeve 34 relative to piston 32 determines the portion of the compression stroke 80 in which metering sleeve 34 covers spill port 74 in piston 32. In the first position, metering sleeve 34 covers spill port 74 for the entire compression stroke 80 of piston 32. In the second position, metering sleeve 34 leaves spill port 74 uncovered for the entire compression stroke 80 of piston 32. Metering sleeve 34 may also be positioned between the first and second positions so that spill port 72 is covered for a portion of the compression stroke of piston 32.

With reference to FIG. 1, pump 20 may include a control device 44 that is operatively engaged with position notch 78 (referring to FIG. 3) to control the position of metering sleeve 34. Control device 44 may be connected to pump outlet 24 through a control line 40. Control device 44 may use pressurized fluid to create a pressure differential over metering sleeve 34 to move metering sleeve 34 in a first direction. A resilient member (not shown), such as, for example, a spring, may be engaged with metering sleeve 34 to move metering sleeve 34 in the opposite direction when the pressure differential is equalized. Thus, the position of metering sleeve 34 relative to piston 32 may be controlled to thereby control the portion of the compression stroke of piston 32 that spill port 72 is covered.

INDUSTRIAL APPLICABILITY

The operation of an exemplary embodiment of the described pumping element will now be described with reference to the figures. The described pump 20 may be included as part of a vehicle to provide pressurized fluid to a system in the vehicle. The vehicle may be, for example, a highway truck or an off-highway work machine.

Operation of the engine of the vehicle results in a rotation of input shaft 52. Rotation of input shaft 52 causes a corresponding rotation of swashplate 28 and driving surface 29. Rotation of driving surface 29 acts to move each piston 32 through a compression stroke, i.e. from the first position towards the second position.

When metering sleeve 34 is in the first position, spill port 72 is covered for the entire compression stroke of piston 32. When piston 32 is moving towards the second position, pressure surface 70 of piston 32 will exert a force on operating fluid disposed in compression chamber 48. The force exerted on the operating fluid will increase the pressure of the fluid. When the pressure of the operating fluid within compression chamber 48 reaches a predetermined limit, check valve 36 will open to allow the pressurized fluid to flow into collector 38.

To reduce the rate at which pressurized fluid is generated, metering sleeve 34 may be moved towards the second position, which will leave spill port 72 uncovered for a greater portion of the compression stroke of piston 32. When spill port 72 is uncovered and piston 32 moves towards its second position, pressure surface 70 will force operating fluid from compression chamber 48 through passageway 74 and spill port 72. Accordingly, when piston 32 is moving towards the second position, pressure surface 70 will not pressurize the operating fluid.

If metering sleeve 34 is positioned between the first and second positions, spill port 72 will move under metering sleeve 34 at some point during the compression stroke of piston 32. When metering sleeve 34 covers, or blocks, spill port 72, operating fluid is not allowed to escape from compression chamber 48. At this point, pressure surface 70 will act to pressurize the operating fluid remaining in compression chamber 48. When the fluid reaches the predetermined pressure, check valve 36 will open to allow the pressurized fluid to flow to collector 38. However, as some operating fluid escaped from compression chamber 48 when spill port 72 was uncovered, the quantity of pressurized fluid released to collector 38 will be less than would have been released had spill port 72 been covered for the entire compression stroke.

As piston 32 slides within metering sleeve 34, spill port 72 will move into fluid communication with grooves 82 in inner surface 84 of metering sleeve 34. In certain situations, such as when the operating fluid in compression chamber 48 is approaching the predetermined limit, the operating fluid may exert a significant force on inner surface 84 of metering sleeve 34. Grooves 82 allow the pressurized fluid to flow around metering sleeve 34. This will distribute the force exerted by the pressurized fluid around the entire metering sleeve 34.

The distribution of the fluid force may reduce or prevent swelling or deformation of metering sleeve 34 that could result from repeated exposure to highly pressurized fluid. Reducing or preventing swelling and/or deformation of metering sleeve 34 may allow a close tolerance to be maintained between metering sleeve 34 and piston 32. This will prevent or reduce an increase in leakage from compression chamber 48 as is typically experienced over an extended operation of pump 20. By maintaining a constant amount of leakage, metering sleeve 34 may prevent a decrease in the volumetric efficiency of pump 20 over time.

In addition, grooves 82 may reduce the force required to move metering sleeve 34 relative to piston 32 or to move piston 32 relative to metering sleeve 34. The presence of grooves 82 in inner surface 84 will reduce the shear area between metering sleeve 34 and outer surface 76 of piston 32. The reduction in shear area translates to a reduction in the drag force experienced when the surfaces of metering sleeve 34 and piston 32 are moved relative to each other. The reduction in force may be particularly apparent when the viscosity of the operating fluid is high, such as when pump 20 is operating in cold conditions. Thus, grooves 82 in metering sleeve 34 may effectively improve the lubrication characteristics between metering sleeve 34 and piston 32.

It will be apparent to those skilled in the art that various modifications and variations can be made in the described pump and pumping element without departing from the scope of the invention. Other embodiments may be apparent to those skilled in the art from consideration of the specification and practice of the pumping element disclosed herein. It is intended that the specification and examples be considered as exemplary only, with a true scope of the present disclosure being indicated by the following claims and their equivalents.

What is claimed is:

1. A pumping element for a hydraulic pump, comprising:

a cylinder forming a compression chamber and having a discharge port;

a piston having a pressure surface, a spill port, and a passageway connecting the pressure surface with the spill port, the piston disposed in the cylinder for reciprocal movement between a first position and a second position, the pressure surface of the piston being adapted to increase the pressure of a fluid disposed in the compression chamber as the piston moves between the first position and the second position, the pressurized fluid flowing through the discharge port of the cylinder; and a metering sleeve disposed around the piston and configured to selectively cover the spill port as the piston reciprocates between the first and second positions, the metering sleeve having a groove being adapted for fluid communication with the spill port as the piston reciprocates between the first and second positions, wherein the metering sleeve includes a plurality of grooves configured to communicate with the spill port as the piston reciprocates between the first and second positions.

2. The pumping element of claim 1, wherein the metering sleeve is moveable between a first position where the metering sleeve covers the spill port as the piston reciprocates between the first and second positions and a second position where the metering sleeve leaves the spill port open as the piston reciprocates between the first and second positions.

3. The pumping element of claim 1, wherein the groove in the metering sleeve extends peripherally around the piston.

4. The pumping element of claim 1, wherein the plurality of grooves are evenly spaced along the metering sleeve.

5. The pumping element of claim 1, wherein the compression chamber includes a fluid inlet.

6. The pumping element of claim 1, further including a check valve disposed in the discharge port and configured to allow pressurized fluid to flow through the discharge port when the pressure of the pressurized fluid reaches a predetermined level.

7. The pumping element of claim 1, further including a resilient member acting on the piston to return the piston to the first position.

8. A hydraulic pump, comprising:

a cylinder forming a compression chamber and having an inlet port and a discharge port;

a piston having a pressure surface, a spill port, and a passageway connecting the pressure surface with the spill port, the piston disposed in the bore for reciprocal movement between a first position and a second position, the pressure surface of the piston being adapted to increase the pressure of a fluid disposed in the compression chamber as the piston moves between the first position and the second position, the pressurized fluid flowing through the discharge port of the cylinder;

a rotatable swashplate having an angled surface adapted to move the piston from the first position to the second position;

a spring acting on the piston to move the piston towards the first position; and a metering sleeve disposed around the piston and configured to selectively cover the spill port as the piston reciprocates between the first and second positions, the metering sleeve having a groove being adapted for fluid communication with the spill port as the piston reciprocates between the first and second positions, wherein the metering sleeve includes a plurality of grooves configured to communicate with the spill port as the piston reciprocates between the first and second positions.

9. The pump of claim 8, further including a control device adapted to control the position of the metering sleeve.

10. The pump of claim 8, wherein the metering sleeve is moveable between a first position where the metering sleeve covers the spill port as the piston reciprocates between the first and second positions and a second position where the metering sleeve leaves the spill port open as the piston reciprocates between the first and second positions.

11. The pump of claim 8, wherein the groove in the metering sleeve extends peripherally around the piston.

12. The pump of claim 8, wherein the plurality of grooves are evenly spaced along the metering sleeve.

13. The pump of claim 8, wherein the compression chamber includes a fluid inlet.

14. The pump of claim 8, further including a check valve disposed in the discharge port and configured to allow pressurized fluid to flow through the discharge port when the pressure of the pressurized fluid reaches a predetermined level.

15. The pump of claim 8, further including a plurality of cylinders and a plurality of pistons.

16. A hydraulic pump, comprising:

a cylinder forming a compression chamber and having an inlet port and a discharge port;

a piston having a pressure surface, a spill port, and a passageway connecting the pressure surface with the spill port, the piston disposed in the bore for reciprocal movement between a first position and a second position, the pressure surface of the piston being adapted to increase the pressure of a fluid disposed in the compression chamber as the piston moves between the first position and the second position, the pressurized fluid flowing through the discharge port of the cylinder;

a rotatable swashplate having an angled surface adapted to move the piston from the first position to the second position;

a spring acting on the piston to move the piston towards the first position; and a metering sleeve disposed around the piston and configured to selectively cover the spill port as the piston reciprocates between the first and second positions, the metering sleeve having a closed groove such that the only opening in the closed groove is located at an inner diameter of the metering sleeve, the closed groove being adapted for fluid communication with the spill port as the piston reciprocates between the first and second positions.

17. The pump of claim 16, further including a control device adapted to control the position of the metering sleeve.

18. The pump of claim 16, wherein the metering sleeve is moveable between a first position where the metering sleeve covers the spill port as the piston reciprocates between the first and second positions and a second position where the metering sleeve leaves the spill port open as the piston reciprocates between the first and second positions.

19. The pump of claim 16, wherein the closed groove in the metering sleeve extends peripherally around the piston.

20. The pump of claim 16, wherein the metering sleeve includes a plurality of closed grooves configured to communicate with the spill port as the piston reciprocates between the first and second positions.

* * * * *